United States Patent [19]

Hammond

[11] Patent Number: 4,492,187

[45] Date of Patent: Jan. 8, 1985

[54] SOOTBLOWER APPARATUS

[75] Inventor: Charles W. Hammond, Lancaster, Ohio

[73] Assignee: The Babcock & Wilcox Company, New Orleans, La.

[21] Appl. No.: 558,380

[22] Filed: Dec. 5, 1983

[51] Int. Cl.[3] ..... F22B 37/52

[52] U.S. Cl. ..... 122/390; 15/316 R; 122/379; 122/392

[58] Field of Search ..... 122/379, 390, 392; 15/316 R, 316 A

[56] References Cited

U.S. PATENT DOCUMENTS

| | | | |
|---|---|---|---|
| 3,230,568 | 1/1966 | Saltz et al. | 122/317 |
| 3,782,336 | 1/1974 | Nelson | 122/379 |
| 4,437,201 | 3/1984 | Zalewski | 15/316 R |

*Primary Examiner*—Edward G. Favors
*Attorney, Agent, or Firm*—Harness, Dickey & Pierce

[57] ABSTRACT

A sootblower of the long retracting variety including a drive system which simultaneously rotates the lance tube as it is inserted and withdrawn from the boiler. A variable speed drive is employed to modulate the rotational speed of the lance tube in accordance with the projected distance of the lance tube such that the lance tube is driven faster at intermediate lance tube projected distances thereby optimizing the cycle time of the sootblower. The modulated rotational speed of the lance tube is maintained at all projected distances below the critical speed which varies as a function of projected distance and the sootblower type. By driving the lance tube at certain projected distances at a rotational speed above the critical speed for other projected distances, the translational speed is increased and cycle time reductions are realized as compared with the prior art wherein the lance tube is driven at a constant speed below the minimum critical speed. The lance tube speed may be varied upon retraction and operated at constant speed for insertion or vice-versa or the speed may be varied both on insertion and retraction, as the cleaning requirements of a particular application requires.

8 Claims, 4 Drawing Figures

SOOTBLOWER APPARATUS

BACKGROUND OF THE INVENTION

This invention relates to a sootblower cleaning apparatus employed to direct jets of air, steam, water, or a mixture of such agents against fouled or slag encrusted components of large scale boilers and other heat exchangers used by public utilities or by industry for the production of steam for power generation and other purposes. The invention relates particularly to sootblowers of the long retracting type, which are moved into the boiler to clean and then withdrawn from the severe environment therein. Sootblowers of this type employ a long retracting lance typically having two or more radially directed nozzles near the tip of the lance.

Typically, as a long retracting sootblower lance is inserted into and retracted from the boiler, it is simultaneously rotated and/or oscillated about its longitudinal axis so that the blowing medium jet emitted from the nozzles sweeps a helical or partially helical path. The lance typically rotates a number of times during its projection and retraction movement. The relationship between the translational and rotational movement of the lance tube determines the helix distance, i.e. the longitudinal distance between helical sweeps of the lance nozzle jet. Helix distance is dictated by the cleaning requirements for a particular application. Cleaning requirements also determine the speed at which the helical jet is advanced. The speed at which the lance may safely be rotated must be maintained below a critical speed at which the lance becomes dynamically unstable. Therefore, the minimum total cycle time required to insert and retract the lance becomes limited by this consideration. In applications where cleaning requirements do not control the rate of helical advancement of the blowing medium jet, the cycle time of the sootblower is dictated solely by the critical speed characteristics. In such instances, a certain minimum flow of blowing medium must be maintained through the lance in order to provide sufficient cooling for the lance to protect it in the severe environment within the boiler, resulting in a considerable waste of blowing medium. Moreover, longer than necessary sootblower cycle time leads to increased power consumption and unnecessary component wear.

This invention is directed to optimizing the cycle duration of a long retracting type sootblower for applications wherein the cycle time during a part of or the entire operating cycle is primarily dictated by the dynamic instability of the lance tube.

Dynamic instability results when the rate of rotation of the lance tube, which is supported by a traveling carriage and by a support near the boiler wall, exceeds the critical speed which is characteristic of the particular sootblower configuration. Dynamic instability results in a resonance condition which can have a highly destructive effect on the lance tube and associated mechanisms. The critical speed at which dynamic instability occurs is a function of the sootblower type and configuration, and occurs at a lower speed when the lance tube is fully inserted into the boiler than when the lance tube is partially inserted.

A principal aspect of this invention is to optimize the total cycle time of a sootblower apparatus of the long retracting type by controlling the speed at which the lance tube is rotated in accordance with the projected length of the lance tube within the boiler and the characteristics of the device such that the rotational speed remains below the critical speed for the lance at each projected length. Since the lance tube becomes unstable at higher speeds at intermediate projected lengths, the lance tube may be safety driven at higher speeds in those positions. By driving the sootblower lance at intermediate projected lengths at a rotational speed greater than the critical speed for a fully extended lance, shorter cycle times are achievable compared to sootblowers according to the prior art wherein constant driving speeds are used. Cycle time reductions are realized for sootblowers having a fixed ratio between the speed of rotation and translation of the lance tube since increases in rotational speed translates into increases in translational speed and therefore cycle time. In sootblower types wherein the speed of lance tube rotation and translation are independently controllable, for example those having separate drive motors, cycle time reduction may be realized since the rotational and translational speeds of the lance tube may be modulated in accordance with the extended length of the lance thereby resulting in cycle time reductions.

Additional benefits and advantages of the present invention will become apparent to those skilled in the art to which this invention relates upon a reading of the described preferred embodiments of this invention taken in conjunction with the acompanying drawings.

DETAILED DESCRIPTION OF THE INVENTION

Figure 1:
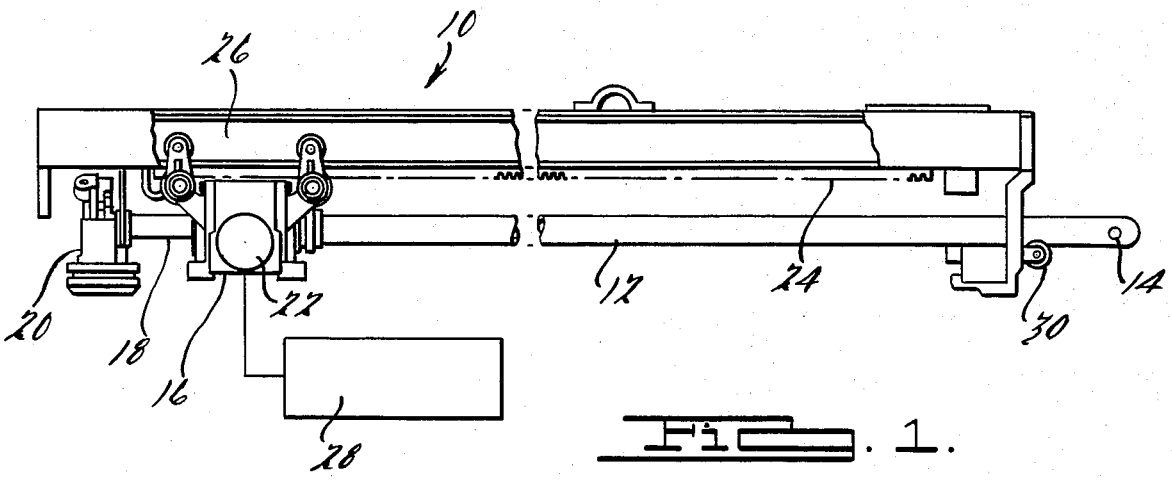
FIG. 1 is a side elevational view, centrally broken away, of a long retracting sootblower of the well-known IK type.

With reference to FIG. 1, a sootblower of the long retracting variety is shown as designated generally by reference character 10, the general construction of which is disclosed by U.S. Pat. No. 2,668,978 granted to L.S. DeMart on Feb. 16, 1954. Numerous additional features have been incorporated into sootblowers of the type shown subsequent to the above-mentioned disclosure (see, for example, U.S. Pat. No. 3,439,376 granted to J. W. Nelson, et al., on Apr. 22, 1969). Such improvements, however, are not involved in the present invention which is readily applicable to these and other sootblowers of the long retracting type. The sootblower depicted by FIG. 1 will be recognized as typical of the structural and usage environment wherein the present invention can be advantageously employed. Lance tube 12 as shown in FIG. 1 is inserted reciprocally into a boiler or furnace presumed to be located to the right in the illustration to clean the heat exchanging and other interior surfaces by the discharge of a blowing agent such as air and/or steam from nozzles 14. Lance tube 12 is affixed to motor driven carriage 16 which controls the movement of the lance tube. Carriage 16 imparts a simultaneous rotational and longitudinal motion to lance tube 12 as it is cycled into and withdrawn from the boiler to perform its cleaning function. Lance tube 12 is slidably overfitted upon stationary feed tube 18. Blowing medium supplied to feed tube 18 is controlled by blow valve 20 and is conducted into lance tube 12 and thereafter exits through nozzles 14. Carriage 16 includes drive motor 22. Heretofore, except in certain water jet sootblowers embodying the principles disclosed in U.S. Pat. No. 3,782,336, granted Jan. 1, 1974, such motors have normally been operated at a constant speed. For this invention, however, a motor which may be operated at variable speeds is preferably used, although other types of variable speed drives might be employed. Drive motor 22 drives carriage 16 by causing rotation of a walking drive gear (not shown) which advances along toothed rack 24 affixed to sootblower main frame or support beam 26. Motor speed controller 28 shown schematically in FIG. 1 provides a means for varying the speed of motor 22 and, therefore, the speed with which lance tube 12 is moved longitudinally and rotated within the boiler interior. The illustrative sootblower blower considered herein has a single drive motor and employs a drive system having a fixed ratio between rate of translation and rotation. In sootblowers having separate motors for rotation and translation, motor speed controller 28 could be connected to the translating motor or both the translating and rotating motors. It is also possible to control each of the motors with separate controllers. The lance tube is supported at all times near the boiler wall outer surface by roller support 30, which is illustrated diagramatically.

A principal aspect of the invention involves varying the driven speed of the lance as a function of the lance tube critical speed of rotation, which varies with lance projected length. Therefore, in order to practice this invention, it is necessary to determine the critical speed characteristics of the lance tube. It has been found that lance instability results primarily due to a rotational exitation. Several means of generating a critical rotation speed versus projected length curve may be utilized. An empirical approach may be employed by extending a lance tube at various projected lengths and driving it rotatably until resonance is observed. Critical speed may also be calculated using a relationship known as Raleigh's method. The method is intended to calculate the critical speed of a rotating shaft having concentrated masses.

Rayleigh's Method is expressed as:

$$C = 187.7 \frac{\Sigma W_n Y_n}{\Sigma W_n Y_n^2}$$

where

C=critical rotational speed in rpm.

$W_n$=weight of lance tube section n.

$Y_n$=static deflection of lance tube section n measured at the center of mass of section n.

Figure 2:
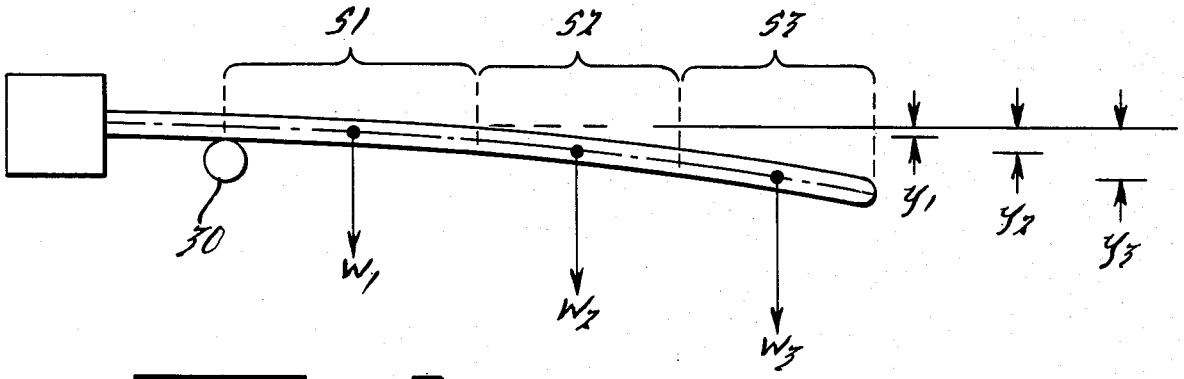
FIG. 2 is a side diagramatic view of a lance tube inserted within a boiler.

With reference to FIG. 2, a pictorial representation of an inserted lance tube 12 is shown. Lance tube 12 is divided into a number of sections designated in the Figure as sections 1 through 3 which together encompass the entire lance tube projected length. The weights and deflections associated with the sections are measured and substituted into the Rayleigh's method equation above.

Although Rayleigh's Method is intended to apply to concentrated masses on shafts, it has been found to provide excellent approximation of the rotational critical speed of lance tubes. The lance tube sections identified in FIG. 2 and employed in the calculation of the Rayleigh's Method equation could be divided into much smaller portions for greater accuracy. It has been found, however, that dividing the lance tube 12 into three sections as depicted by FIG. 2 provides estimations of critical speed of sufficient accuracy. Through empirical testing, the inventor has established the validity of Rayleigh's Method as applied to sootblower lance tubes. The Method produces estimations of the actual onset of a resonant condition of the lance tube. With reference to Rayleigh's Method above, it can be seen that as deflections increase, the critical speed of the lance tube decreases. Therefore, the lance tube critical speed at full extension is much lower than at intermediate positions. The critical speed at full extension limits the rotational speed of a constant speed blower even through faster speeds would be allowable at travels less than full lance tube extension.

Figure 3:
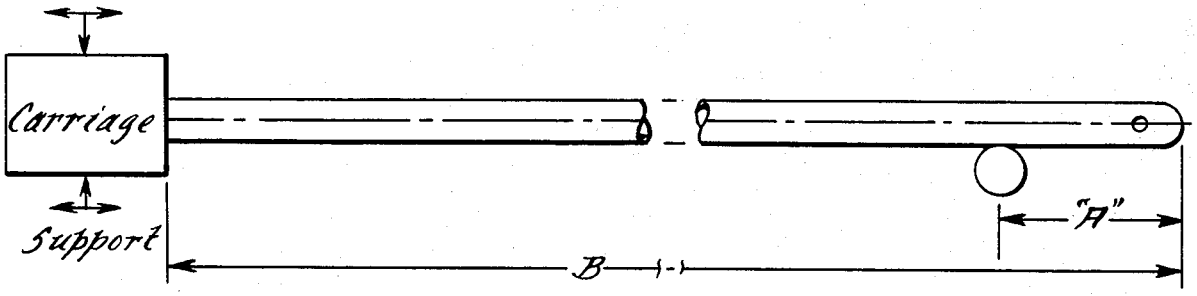
FIG. 3 is another side diagramatical view of a lance tube providing dimensions used in FIG. 4.
Figure 4:
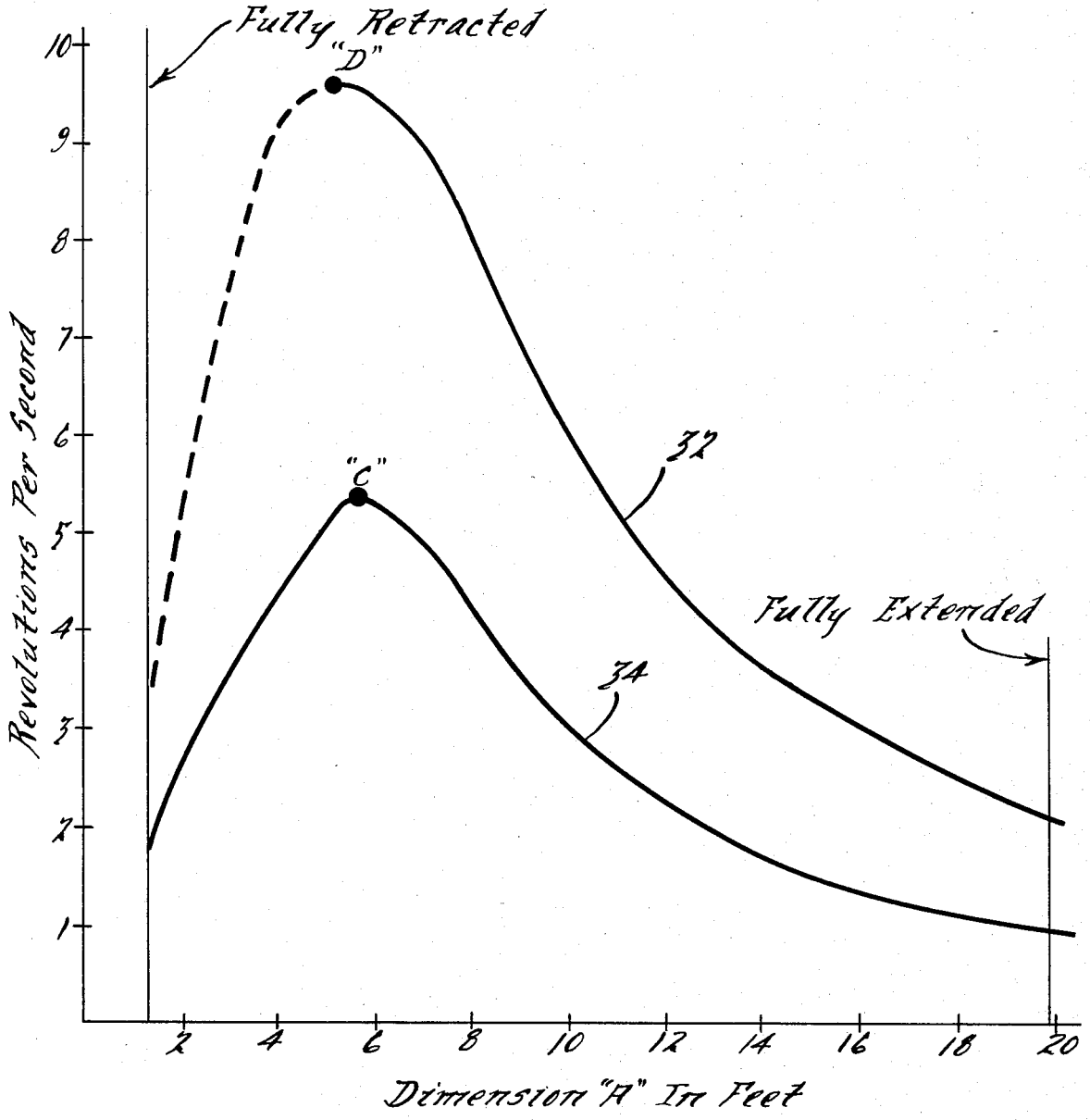
FIG. 4 is a graphical representation illustrating the relationship between the critical rotational speed of a lance tube and the lance overhung distance. The Figure further provides an illustrative operating speed curve for a lance tube which embodies the principal aspects of this invention.

FIG. 3 shows dimension "A" which is the variable lance tube overhung distance plotted along the abscissa in FIG. 4. Dimension "B" in FIG. 3 is the total lance tube length. The ordinate of the graph of FIG. 4 is the rate of rotation of the lance tube in revolutions per second or Hertz. With reference to FIG. 4, a graph is shown illustrating on the top curve 32, a limiting relationship between rotational lance speed in revolutions per second versus the lance overhung length and on bottom curve 34, a preferred safe operating curve. Curve 32 shows the critical speed of a typical twenty foot sootblower as determined by actual test. From curve 32 it will be seen that at full retraction the critical speed is low, due to the unsupported length of the retracted lance tube, but it increases sharply to an intermediate position, D, and then decreases sharply to a low value at full extension as the length of the cantilevered projecting portion of the lance tube in the boiler increases. The effect of the critical speed for the retracted lance portions supported at both ends is evident with reference to curve 32 and is significant from a fully retracted position to the extended position corresponding to point "D". The critical speed of the lance at small overhung distances caused by resonance of the retracted lance portion may be increased in providing one or more intermediate supports located between carriage 16 and roller support 30. Such an intermediate support is disclosed by U.S. Pat. No. 3,439,376 granted on 4-22-69 to J. E. Nelson et al.

Curve 34 shown by FIG. 4 is an exemplary lance tube speed operating curve selected as a result of the findings indicated by curve 32. As shown by this operating curve, the lance is driven at 50% of the critical speed of the lance. The 50% operating speed as compared to critical speed is desirable to insure that lance tube 12 does not develop a resonant condition. Outside excitation of the lance tube, such as caused by slag striking the lance tube during operation or other force inputs may also cause the lance tube to resonate at below the theoretical speed of resonance onset. Heating of the lance tube also causes a decrease in critical speed since the lance tube material modulus of elasticity changes in such environments. For these reasons, it is desirable to stay well below the actual critical speed of the lance. A less conservative margin of 30% below the maximum, however, is believed to provide adequate resonance protection for applications where cycle time reductions are particularly desirable. On operating curve 34, point "C" identifies the maximum lance tube rotational speed. The maximum speed is well above the critical speed of the fully extended lance, unlike systems operated according to the teaching of the prior art. By varying the lance tube rotational speed so as to maintain the rate of rotation as closely beneath the "safety limit" curve 32 as practicable while still achieving effective cleaning, the cycle time of the system can be optimized thereby resulting in considerable savings of blowing medium, energy consumption and component wear. Cycle time reductions result since increased rotational speeds permit a concomitant increase in translational speed while maintaining a desired helix distance.

Speed variation of soot blower drive motor 22 may be accomplished by numerous means. For example, a continuously variable speed drive may be employed having a variable frequency power supply and an alternating current drive motor. Other types of controlling systems can be used with equal success. The speed control operating curve can be based on lance positions or time from the start of blower operation. Sensors along the length of the blower could also be used to determine lance position, which information may be employed to modulate the lance driving speed.

It will be recognized that this invention permits operating the lance at much higher rotational speeds during most of its travel than is possible with constant speed blowers. Higher rotational speeds permits increased translational speeds, thereby decreasing cycle time while maintaining a desired helix distance. Depending upon cleaning requirements, it may not be practical to increase the speed to the maximum indicated by intermediate portions of the curve 34. In these applications, it may be desirable to provide a constant speed of lance insertion or a constant speed of lance retraction and vary the other reciprocal motion in accordance with the teachings of this invention. For these applications, when adequate boiler cleaning is achieved during insertion or retraction, the total cycle time can be reduced by optimizing the other part of the cycle in accordance with the teachings of this invention.

It will be further recognized that this invention permits a variation in the helix distance versus the projected length of the lance tube for sootblowers having independently controlleable rotation and translational movements. In certain applications employing such sootblowers, it may be desireable to increase the speed of lance rotation at intermediate projected distances while maintaining a nearly constant translational speed, resulting in a shorter of "tighter" helix at the intermediate distances. Such shorter helix distance may be desireable in order to achieve desired clearing performance. In such sootblowers, if both motors are operated at constant speeds, the smallest needed helix distance will exist over the entire range of lance translational movement, resulting in a longer than necessary cycle time. Cycle times become longer for shorter helix distance since resonance limits rotational speeds and translational speed is directly related to helix distance and rotational speed.

While preferred embodiments of the invention have been described herein, it will be appreciated that various modifications and changes may be made without departing from the spirit and scope of the appended claims.

I claim:

1. In a sootblower apparatus of the type having a lance tube and drive means for translating said lance tube into and out of a boiler or the like and simultaneously rotating the lance tube, wherein the unsupported length of said lance tube varies during its inward and outward movement, and means for supplying a blowing agent to an outer end of said lance tube, the improvement comprising:

variable speed modulation controller means for the drive means such that the speed at which the lance tube is rotated is at a maximum value when the lance tube is in a position intermediate its fully extended and fully retracted positions within the boiler, and reduces gradually as the lance tube moves toward the fully extended position, the rate of rotation being at all times below the critical speed at which resonance occurs, thereby optimizing the cycle time of the sootblower apparatus.

2. In a sootblower apparatus of the type having a lance tube and drive means for moving said lance tube into and out of a boiler or the like and simultaneously rotating the lance tube, wherein the unsupported length of said lance tube varies during its inward and outward movement, and means for supplying a blowing agent to an outer end of said lance tube, the improvement comprising:

variable speed modulation controller means for the drive means such that the speed at which the lance tube is rotated is at a maximum value when the lance tube is in a position intermediate its fully extended and fully retracted positions within the boiler, and reduces gradually as the lance tube moves toward the fully retracted position, the rate of rotation being at all time below the critical speed at which resonance occurs, thereby optimizing the cycle time of the sootblower apparatus.

3. In a sootblower apparatus of the type having a lance tube and drive means for translating said lance tube into and out of a boiler or the like and simultaneously rotating the lance tube, wherein the unsupported length of said lance tube varies during its inward and outward movement, and means for supplying a blowing agent to an outer end of said lance tube, the improvement comprising:

variable speed modulation controller means for the drive means such that the speed at which the lance tube is rotated is at a maximum value when the lance tube is in a position intermediate its fully extended and fully retracted positions within the boiler, and reduces gradually as the lance tube moves away from said intermediate position, toward the fully extended and fully retracted positions, the rate of rotation being at all times below the critical speed at which resonance occurs, thereby optimizing the cycle time of the sootblower apparatus.

4. In a sootblower apparatus of the type having a lance tube, and drive means for moving said lance tube into and out of a boiler or the like and for simultaneously rotating said lance tube wherein the projected unsupported length of said lance tube varies during its inward and outward movement, and means for supplying a blowing agent to an outer end of said lance tube, the improvement comprising:

variable speed modulation controller means for the drive means such that the speed at which the lance tube is moved at all projected distances remains below the speed at which resonance occurs at all projected distances wherein the lance tube is operated at a speed which is a fixed percentage of the speed at which resonance occurs at all projected distances thereby optimizing the cycle time of the sootblower.

5. In a sootblower apparatus of the type having a lance tube and drive means for translating said lance tube into and out of a boiler or the like and for simultaneously rotating said lance tube wherein the unsupported length of said lance tube varies during its inward and outward movement, and means for supplying a blowing agent to an outer end of said lance tube, the improvement comprising:

variable speed modulation controller means for the drive means such that the lance tube is rotated at a constant rate as the lance tube progresses into the boiler and is rotated at a variable rate below the critical speed of the lance tube at which resonance occurs at all lance tube extended distances while the lance tube is being retracted from said boiler, thereby optimizing the cycle time of the lance tube retraction.

6. In a sootblower apparatus of the type having a lance tube and drive means for translating said lance tube into and out of a boiler or the like and for simultaneously rotating said lance tube wherein the unsupported length of said lance tube varies during its inward and outward movement, and means for supplying a blowing agent to an outer end of said lance tube, the improvement comprising:

variable speed modulation controller means for the drive means such that the lance tube is rotated at a variable rate below the critical speed of the lance tube at all lance tube extended distances as the lance tube progresses into the boiler thereby optimizing the cycle time of lance tube insertion, and is rotated at a constant rate as the lance tube is retracted from said boiler.

7. In a sootblower apparatus of the type having a lance tube and drive means for translating said lance tube into and out of a boiler or the like and for simultaneously rotating said lance tube wherein the unsupported length of said lance tube varies during its inward and outward movement, and means for supplying a blowing agent to an outer end of said lance tube, the improvement comprising:

variable speed modulation controller means for the drive means such that the speed at which the lance tube is rotated at a position intermediate its fully extended and fully retracted positions exceeds the speed at which the lance tube resonance occurs when the lance tube is fully extended, and the lance tube is moved to the fully extended position from said intermediate position at speeds below those which cause a resonant condition thereby optimizing the cycle time of said sootblower apparatus.

8. A method of optimizing the operating cycle time of a sootblower having a long retracting rotatable lance tube comprising the steps of:

determining the rotational speeds at which resonance of said lance occurs versus the projected length of said lance tube throughout its travel, and controlling the speed at which said lance tube is rotated in accordance with said projected length of said lance such that said lance is always operated below its critical speed at all projected distances and said lance is operated at certain projected distances at a speed higher than the critical speed of said lance in a fully extended position.

* * * * *

UNITED STATES PATENT AND TRADEMARK OFFICE

CERTIFICATE OF CORRECTION

PATENT NO. : 4,492,187

DATED : January 8, 1985

INVENTOR(S) : Charles W. Hammond

It is certified that error appears in the above-identified patent and that said Letters Patent is hereby corrected as shown below:

Col. 2, Line 28, "acompanying" should be --accompanying--.

Col. 3, Line 23, the second occurrence of "blower" should be deleted.

Col. 3, Lines 46 and 65, "method" should be --Method--.

Col. 3, Lines 49 and 67, and Col. 4, Lines 4, 10 and 13, "Rayleigh's" should be --Raleigh's--.

Col. 4, Line 46, "in" should be --by--.

Col. 5, Line 47, "controlleable" should be --controllable--.

Col. 5, Lines 49 and 53, "desireable" should be --desirable--.

Col. 5, Line 54, "clearing" should be --cleaning--.

Col. 6, Line 34, Claim 2, "time" should be --times--.

UNITED STATES PATENT AND TRADEMARK OFFICE

CERTIFICATE OF CORRECTION

PATENT NO. : 4,492,187

DATED : January 8, 1985

INVENTOR(S) : Charles W. Hammond

It is certified that error appears in the above-identified patent and that said Letters Patent is hereby corrected as shown below:

Col. 3, Lines 50 to 53, $$C = 187.7\sqrt{\Sigma \frac{W_n Y_n}{\Sigma W_n Y_n^2}}$$

Signed and Sealed this

First Day of October 1985

[SEAL]

*Attest:*

*Attesting Officer*

DONALD J. QUIGG

*Commissioner of Patents and Trademarks—Designate*